US009131793B2

(12) United States Patent
Cross

(10) Patent No.: US 9,131,793 B2
(45) Date of Patent: Sep. 15, 2015

(54) PATTERNING FOR CONSTRUCTABLE UTENSIL

(71) Applicant: EcoTensil Inc., Larkspur, CA (US)

(72) Inventor: Peggy V. K. Cross, Larkspur, CA (US)

(73) Assignee: EcoTensil Inc., Corte Madera, CA (US)

( * ) Notice: Subject to any disclaimer, the term of this patent is extended or adjusted under 35 U.S.C. 154(b) by 145 days.

(21) Appl. No.: 13/797,446

(22) Filed: Mar. 12, 2013

(65) Prior Publication Data

US 2014/0069933 A1 Mar. 13, 2014

Related U.S. Application Data

(60) Provisional application No. 61/699,808, filed on Sep. 11, 2012, provisional application No. 61/699,787, filed on Sep. 11, 2012.

(51) Int. Cl.

| | |
|---|---|
| ***A47G 21/04*** | (2006.01) |
| ***A47G 19/03*** | (2006.01) |
| ***B65D 3/08*** | (2006.01) |
| ***B31B 1/25*** | (2006.01) |
| ***A47G 21/06*** | (2006.01) |
| *A47G 21/00* | (2006.01) |

(52) U.S. Cl.

CPC ..... *A47G 19/03* (2013.01); *A47G 21/04* (2013.01); *A47G 21/06* (2013.01); *B31B 1/25* (2013.01); *B65D 3/08* (2013.01); *A47G 2021/002* (2013.01)

(58) Field of Classification Search

USPC ..... 229/401; 30/324–328, 345; 294/180

See application file for complete search history.

(56) References Cited

U.S. PATENT DOCUMENTS 636,735 A * 11/1899 Davenport ..... 294/180
652,350 A * 6/1900 Davenport ..... 294/180

(Continued)

FOREIGN PATENT DOCUMENTS

EP 1142522 A1 * 10/2001 ..... A47G 2021/002
FR 2942461 A1 * 8/2010 ..... A47G 21/04

(Continued)

OTHER PUBLICATIONS

ECO-Scoop—Light Objects—A Design Competition About Sustainability—printed Sep. 16, 2011—url: http://www.core77.com/lightobjects/brief.asp and http://www.core77.com/lightobjects/img/1344/default.asp referencing an exhibition starting in Oct. 17, 2006.

(Continued)

*Primary Examiner* — Gary Elkins

(74) *Attorney, Agent, or Firm* — Patent Law Offices of Michael E. Woods; Michael E. Woods

(57) ABSTRACT

A system and method for reducing manufacturing costs of patterned constructible utensils and improving their constructability. One constructible utensil includes a set of scores (e.g., a quad of scores including an outer pair and an inner pair, a single such pair, or other number of scores) that are shaped to converge when moving from a bowl-region towards the handle portion. The scores do not intersect but stop and produce various alterations in the converging score pattern. These alterations in the converging pattern help with propagation of a bowl-forming fold responsive to a constructing manipulation of the handle portion (e.g., folding, bending, and other operation on the handle portion and one or more scores on the handle portion).

9 Claims, 7 Drawing Sheets

(56) References Cited

U.S. PATENT DOCUMENTS

| | | | | |
|---|---|---|---|---|
| 1,128,114 | A | | 2/1915 | Doellinger |
| 1,521,768 | A | * | 1/1925 | Herrmann ..... 30/328 |
| 1,625,335 | A | | 4/1927 | Schneider |
| 1,633,605 | A | | 6/1927 | Prudden |
| 1,657,325 | A | | 1/1928 | Suttle |
| 1,808,949 | A | | 6/1931 | Flynn |
| 1,851,942 | A | * | 3/1932 | Christie ..... 30/328 |
| 1,907,737 | A | | 5/1933 | Christie |
| 2,375,266 | A | | 5/1945 | Wilson |
| 2,433,926 | A | | 1/1948 | Sayre |
| 2,453,393 | A | | 11/1948 | Wilson |
| 2,598,987 | A | | 6/1952 | Franzen |
| 2,728,516 | A | | 12/1955 | Rodman |
| 2,745,586 | A | | 5/1956 | Thoma |
| 3,334,778 | A | | 8/1967 | Saunders |
| 3,367,484 | A | | 2/1968 | Nelson |
| 3,458,107 | A | | 7/1969 | Lane et al. |
| 3,487,974 | A | | 1/1970 | Schovee |
| 3,514,029 | A | | 5/1970 | Powell |
| 3,526,566 | A | * | 9/1970 | McIlvain, Jr. et al. ..... 428/121 |
| 3,722,779 | A | | 3/1973 | Chang |
| 3,828,999 | A | | 8/1974 | Humphrey |
| 3,931,925 | A | | 1/1976 | Ruff |
| 3,955,742 | A | | 5/1976 | Marshall et al. |
| 3,961,566 | A | | 6/1976 | Westphal et al. |
| 4,036,398 | A | | 7/1977 | Hoogvelt et al. |
| 4,060,176 | A | | 11/1977 | Tobiasson |
| 4,201,795 | A | | 5/1980 | Yamanaka |
| 4,218,010 | A | | 8/1980 | Ruff |
| 4,324,343 | A | | 4/1982 | Moller |
| 4,348,421 | A | | 9/1982 | Sakakibara et al. |
| 4,393,988 | A | | 7/1983 | Burke |
| D270,887 | S | | 10/1983 | Allgeyer et al. |
| 4,413,034 | A | | 11/1983 | Anderson |
| 4,635,843 | A | | 1/1987 | Tomlinson |
| D295,383 | S | | 4/1988 | Anderson et al. |
| 4,836,593 | A | | 6/1989 | Cooley |
| D309,210 | S | | 7/1990 | Seyfert |
| 4,940,189 | A | | 7/1990 | Cremonese |
| 4,962,849 | A | | 10/1990 | Anderson |
| 5,011,006 | A | | 4/1991 | Anderson |
| 5,381,905 | A | | 1/1995 | Mallmamm et al. |
| 5,419,049 | A | | 5/1995 | MacArthur-Onslow |
| 5,695,084 | A | | 12/1997 | Chmela et al. |
| 5,705,212 | A | | 1/1998 | Atkinson |
| 5,884,953 | A | | 3/1999 | Leighton et al. |
| 5,992,667 | A | | 11/1999 | Huang |
| 6,308,833 | B1 | | 10/2001 | Oravez |
| 6,371,324 | B1 | | 4/2002 | Torniainen et al. |
| 6,604,645 | B1 | | 8/2003 | Vaupotic |
| 6,604,646 | B2 | | 8/2003 | Tomiainen et al. |
| D530,986 | S | | 10/2006 | Lago-Arenas |
| 7,275,652 | B2 | | 10/2007 | Morris et al. |
| D554,951 | S | | 11/2007 | McGrath |
| D571,162 | S | | 6/2008 | Fite, IV et al. |
| 7,637,417 | B2 | | 12/2009 | Fite, IV et al. |
| D612,692 | S | | 3/2010 | Menceles |
| 7,823,743 | B2 | | 11/2010 | McKahan et al. |
| D646,529 | S | | 10/2011 | Cross |
| D651,480 | S | | 1/2012 | Cross |
| 8,201,862 | B2 | | 6/2012 | Langley |
| 8,210,381 | B2 | | 7/2012 | Cross |
| 8,695,828 | B2 | | 4/2014 | Cross |
| 2002/0060220 | A1 | | 5/2002 | Torniainen et al. |
| 2002/0114870 | A1 | | 8/2002 | Rebhorn et al. |
| 2005/0115974 | A1 | | 6/2005 | Micciulla |
| 2007/0084064 | A1 | | 4/2007 | Fite et al. |
| 2007/0227919 | A1 | | 10/2007 | True |
| 2008/0072432 | A1 | | 3/2008 | Teys et al. |
| 2008/0110885 | A1 | | 5/2008 | Cross |
| 2008/0245682 | A1 | | 10/2008 | Foulke |
| 2010/0194128 | A1 | | 8/2010 | Langley |
| 2011/0303678 | A1 | | 12/2011 | Zomorodi et al. |
| 2012/0052162 | A1 | | 3/2012 | Goulart |
| 2013/0097877 | A1 | | 4/2013 | Cross |
| 2014/0069933 | A1 | | 3/2014 | Cross |

FOREIGN PATENT DOCUMENTS

| | | | |
|---|---|---|---|
| JP | 52012089 | U | 1/1977 |
| JP | 53068780 | U | 6/1978 |
| JP | 3032192 | U | 12/1996 |
| JP | 10019636 | A | 1/1998 |
| JP | 2000162016 | A | 6/2000 |
| JP | 2000166735 | A | 6/2000 |
| JP | 3281262 | B2 | 5/2002 |
| JP | 3374276 | B2 | 2/2003 |
| JP | 3636280 | B2 | 4/2005 |
| KR | 1020020026221 | A | 4/2002 |
| KR | 200382814 | Y1 | 4/2005 |
| WO | 2007048055 | A2 | 4/2007 |
| WO | 2008061080 | A2 | 5/2008 |

OTHER PUBLICATIONS

11559518—EcoScoop_Arran Smith.pdf, "Eco-Scoop Biodegradable Eating Utensil", Arran Smith, Corflot, 2004 Exhibition, pp. 1-5, http://www.coroflot.com/ags/Eco-Scoop/1, Retrieved Dec. 5, 2011.

* cited by examiner

PATTERNING FOR CONSTRUCTABLE UTENSIL

CROSS REFERENCE TO RELATED APPLICATIONS

This application claims the benefit of U.S. Provisional Application No. 61/699,808, filed 11 Sep. 2012, and claims the benefit of U.S. Provisional Application No. 61/699,787, filed 11 Sep. 2012, the contents of which are expressly incorporated in their entireties for all purposes by reference thereto.

BACKGROUND OF THE INVENTION

The present invention relates generally to manufacturing constructible utensils, and more specifically, but not exclusively, to improving score patterns for improved operation and reduction of manufacturing costs.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

In the field of constructible utensils, it is known to provide some type of positive score to a special paper blank to aid in constructing (e.g., bending, folding, and the like) the paper blank into the desired configuration. The manner of creating the paper blank and application of the scoring greater influences the usability and commercial viability of the product.

When implemented as a commodity product for disposable tasting of foodstuff, the price is a primary consideration (along with satisfaction of other goals of meeting various standards for waste (e.g., compostability) and consumer's other use and environmental concerns).

The annual market size of disposable utensils is in the billions of units, and any reduction in cost is significantly magnified by that volume. There is always a trade-off in cost reduction to maintain usability. For consumers, usability includes mouth feel and whether the constructed utensil is able to operate for the intended purpose. For example, certain types of foodstuff are better suited to one type of constructed utensil than another. Even when the class of constructed utensil is correct, the appropriateness of the constructed utensil is further gauged as to whether it may be predictably constructed into the desired utensil.

For constructible utensils that include manufactured score lines that influence the shaping of the utensil as it is constructed, having a score pattern that improves predictable shaping greatly aids in consumer acceptance.

What is needed is a system and method for reducing manufacturing costs of patterned constructible utensils and improving constructability.

BRIEF SUMMARY OF THE INVENTION

Disclosed are a system and method for reducing manufacturing costs of patterned constructible utensils and improving constructability.

The following summary of the invention is provided to facilitate an understanding of some of technical features related to constructible utensils, and is not intended to be a full description of the present invention. A full appreciation of the various aspects of the invention can be gained by taking the entire specification, claims, drawings, and abstract as a whole. The present invention is applicable to other utensil patterns, other base foundation (e.g., non-paper) and other constructible blanks that include patterning.

One utensil embodiment includes a set of scores (e.g., a quad of scores including an outer pair and an inner pair, a single such pair, or other number of scores) that are shaped to converge when moving from a bowl-region towards the handle portion. The scores do not intersect but stop and produce various alterations in the converging score pattern. These alterations in the converging pattern help with propagation of a bowl-forming fold responsive to a constructing manipulation of the handle portion (e.g., folding, bending, and other operation on the handle portion and one or more scores on the handle portion).

These alterations in the scoring pattern include introduction of discontinuities and inflection points that alter trajectories of the scores and/or influence propagation of the bowl-forming operation from the handle onto the bowl portion.

A constructible utensil, including a deformable generally planar rigid paperboard sheet defining a blank, the blank including a handle portion having: a handle length extending from a first proximal end to a first distal end opposing the proximal end along a first longitudinal axis, the first distal end including a first distal end width perpendicular to the first longitudinal axis; and a free edge at the first proximal end; and a terminal portion having: a terminal portion length extending from a second proximal end to a second distal end opposing the second distal end along a second longitudinal axis aligned with the first longitudinal axis, the aligned axes forming a central fold axis about which the handle portion and the terminal portion are generally symmetric wherein the second proximal end is coupled to the first distal end and wherein the second distal end includes a curvilinear free edge; and a terminal portion width perpendicular to the second longitudinal axis equal to the first distal end width; and a bowl-forming score pattern including a first continuous score disposed on the blank and extending from a first point spaced away from the fold axis on the handle portion towards a second point on the blank at a first lateral edge proximate the first distal end and a second continuous score disposed on the blank and extending from a third point spaced away from the fold axis on the handle portion towards a fourth point on the blank at a second lateral edge proximate the first distal end, the second continuous score symmetric with the first continuous score about the fold axis; wherein the scores generally curve away from the fold axis and wherein the score pattern does not include intersecting scores; and wherein the blank is configured with an arrangement of the scores such that a folding of the blank about the fold axis introduces a bowl in the blank by distortion of the blank along the score pattern.

A method for applying a bowl-forming score pattern to a blank constructible utensil, including a) placing the blank constructible utensil into a scoring position; and thereafter b) printing the bowl-forming score pattern using a die having non-intersecting score-line elements, wherein the bowl-forming score pattern includes a first continuous score disposed on the blank that extends from a first point spaced away from a fold axis on a handle portion towards a second point on the blank at a first lateral edge proximate a first distal end and a second continuous score disposed on the blank that extends from a third point spaced away from the fold axis on the handle portion towards a fourth point on the blank at a second lateral edge proximate the first distal end, the second continuous score symmetric with the first continuous score about the fold axis.

Any of the embodiments described herein may be used alone or together with one another in any combination. Inventions encompassed within this specification may also include embodiments that are only partially mentioned or alluded to or are not mentioned or alluded to at all in this brief summary or in the abstract. Although various embodiments of the invention may have been motivated by various deficiencies with the prior art, which may be discussed or alluded to in one or more places in the specification, the embodiments of the invention do not necessarily address any of these deficiencies. In other words, different embodiments of the invention may address different deficiencies that may be discussed in the specification. Some embodiments may only partially address some deficiencies or just one deficiency that may be discussed in the specification, and some embodiments may not address any of these deficiencies.

Business-to-business pre-consumer concerns include cube utilization (quantity per volume) which impacts other concerns of shipping and storage. Cube utilization is enhanced by minimizing the amount of paperboard used in each constructible utensil making optimization of shapes and patterning extremely important for long term success.

Some embodiments are particularly beneficial for obtaining desired quantities (e.g., a tasting sample) of firmer/solid substances (e.g., hard serve ice cream) that can induce bowl bending in some embodiments having a different scoring pattern.

Other features, benefits, and advantages of the present invention will be apparent upon a review of the present disclosure, including the specification, drawings, and claims.

BRIEF DESCRIPTION OF THE DRAWINGS

The accompanying figures, in which like reference numerals refer to identical or functionally-similar elements throughout the separate views and which are incorporated in and form a part of the specification, further illustrate the present invention and, together with the detailed description of the invention, serve to explain the principles of the present invention.

DETAILED DESCRIPTION OF THE INVENTION

Embodiments of the present invention provide a system and method for reducing manufacturing costs of patterned constructible utensils and improving constructability. The following description is presented to enable one of ordinary skill in the art to make and use the invention and is provided in the context of a patent application and its requirements.

Various modifications to the preferred embodiment and the generic principles and features described herein will be readily apparent to those skilled in the art. Thus, the present invention is not intended to be limited to the embodiment shown but is to be accorded the widest scope consistent with the principles and features described herein.

There are many types of constructible utensils to which the present invention may be applicable. U.S. Patent Application 61/435,975 filed 25 Jan. 2011 describes some representative, but not exclusive, utensils to which the present invention may be applied. The patent application is hereby expressly incorporated by reference thereto in its entirety for all purposes.

Discussed herein are application and arrangement of a bowl-forming scoring pattern on a planar blank that produces a bowl in a constructible utensil when an unconstructed and undistorted blank is constructed/distorted along a fold line, the distortion propagating along scores of the scoring pattern. For purposes of this patent application, the bowl-forming scoring pattern includes the set of scores that produce a shaped and contoured curvilinear three-dimensional bowl when the blank is folded. The bowl-forming scoring pattern includes, when present, scores that define a fold axis as well as those that propagate any folding/distortion that create the bowl. The scores of the bowl-forming scoring pattern are all applied by a single die having score-line elements that create the score elements on the blank that do not merge and continue.

Figure 1:
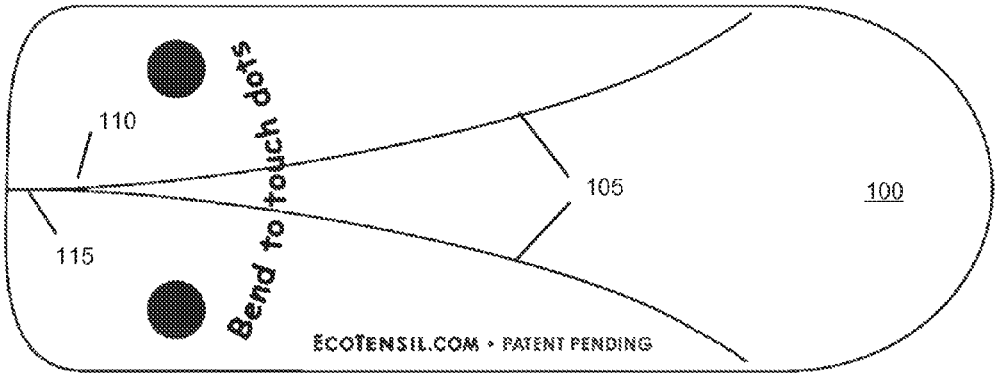
FIG. 1 illustrates a constructible utensil including a conventional scoring pattern.

FIG. 1 illustrates a constructible utensil 100 including a scoring pattern including a pair of curved converging and continuing scores 105. Scores 105 meet at an intersection 110 and continue as a single straight score 115. Typically, but not required, scores 105 are symmetric about a longitudinal axis that extends from an edge of a handle to an edge of a bowl-forming region, the axis dividing utensil in two halves, often but not always these two halves are symmetric, and when they are symmetric it is common for them to be symmetric about the longitudinal axis.

A version of constructible utensil 100 illustrated in FIG. 1 has existed in the past which was manufactured using a sheet-fed die cutter that employed a cutting die that also was able to add the scoring pattern as shown. This is in contrast to the high-speed rotary printing presses described elsewhere herein.

One potential usability concern with the score pattern shown in FIG. 1 that can be improved is that folding along the longitudinal axis (i.e., "bend to touch dots") can sometimes result in an uneven bend about one of the two curved scores (one score bends more dominantly than the other in response to bending/folding of the handle). That uneven bending may sometimes produce an uneven utensil and can, under some circumstances, degrade performance for certain foodstuffs. No matter how uncommon such an occurrence, it is desirable to improve the performance particularly given the large volumes of such products.

For some systems, there is also manufacturability concern for manufacturing a score pattern such as shown in FIG. 1 where two scores converge at an intersection and continue past the intersection. Manufacturing methods must be taken into account for making large volume commodity products. The present embodiments are designed for high-speed rotary printing presses to generate a plurality of blanks, each blank made of paperboard or other flat foldable/bendable material that defines a desired outer perimeter with scores added to each blank during the rotary printing process (e.g., debossing and the like). The novel high-speed rotary printing process for manufacturing constructible utensils in this fashion already achieves considerable cost savings over alternative manufacturing systems.

The printing method includes the steps of providing a web of material to be formed into blanks, and using that web as an input in the rotary process. The press includes plates (or dies) with patterns for cutting several blanks at once, as well as for patterning (debossing, scoring, and the like). The blanks are collected and packaged. In some systems, the output includes a plurality of sheets, each sheet including a plurality of blanks "nicked" to the sheet to be easily and readily separated for collection and packaging. Some aspects of the present invention are applicable to sheet-fed printing solutions as well and the present invention is not limited to high-speed rotary printing.

However, the score pattern of FIG. 1 is problematic for certain printing systems as it is costly, if at all economically possible, to make a male/female score-producing die for use in the particular high-speed rotary printing process that includes two metal "blades" that merge perfectly together to produce a perfect "Y" shaped intersection shown in FIG. 1. Besides the appearance of a non-perfect Y-shaped intersection, any imperfection can contribute to the uneven folding described above. In cases where attempts are made for these plates/dies to be manufactured, the plate/die with these intersecting elements typically will make far fewer impressions than a plate/die with non-intersecting blades before damage, requiring repair and/or replacement. Thus using a bowl-forming score pattern with non-intersecting and continuing score elements produces constructible utensils at a lower total unit cost as it enables cost-effective alternative manufacturing techniques. Unit cost is particularly important for single-use disposable constructible utensils, such as illustrated and described herein.

Thus re-creation of the "Y" shaped score pattern using a more economical manufacturing process is problematic for either or both of these reasons. The problem is compounded when the product being manufactured is relatively small (e.g., constructible utensil 100 illustrated in FIG. 1 is about 1.25 inches wide by 3.25 inches long, though it may be manufactured having different dimensions). When small like this and used in a "tasting" application, such as for food samples from a vendor, there is a desire to make the cost as low as possible. As the constructible utensil becomes larger, such as one designed for consuming a container full or other commercial-quantity of foodstuff, the utensil has a longer use and cost alone is not a single important parameter which includes ease of use, packaging (including delivery to the consumer), and utensil quality. At some point, sheet fed die cutting machines which may operate on a stack of paperboard stock at once may be cost-effective in some situations. So while one aspect of the improved scoring pattern may not applicable in all cases (e.g., a limitation on merging and continuing scores), a concern with designation and implementation of a scoring pattern that produces a predictably uniform constructed utensil is still present and those aspects of the present invention continue to be applicable.

Figure 2:
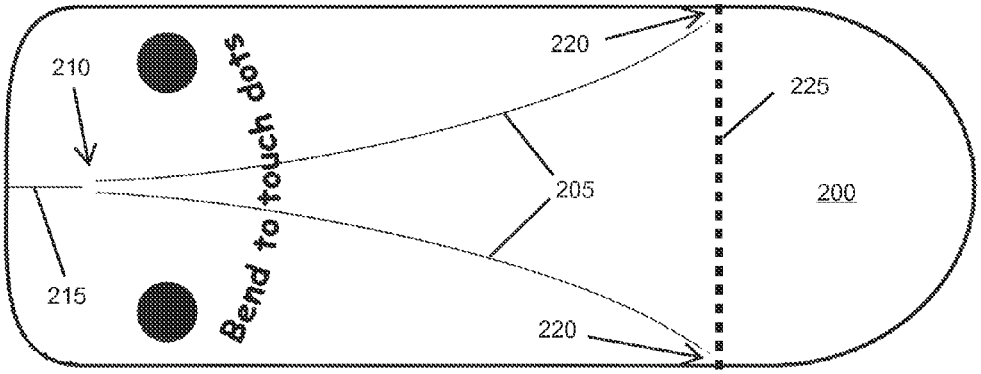
FIG. 2 illustrates a constructible utensil including a first improved scoring pattern.

FIG. 2 illustrates a constructible utensil 200 including a first improved scoring pattern. Constructible utensil 200 includes a pair of scores 205, which may be curved as shown but are not required to be such (the curve may be more or less convex/concave and/or terminate closer to or further away from an edge, for example), that are shaped to converge when moving from a bowl-region towards the handle portion. However in contrast to FIG. 1, scores 205 do not intersect but stop and produce a discontinuity 210 in the score pattern. Discontinuity 210 are spaced away from (preferably symmetrically spaced from) the fold axis a small distance (e.g., less than ¼" and more preferably ⅛" or smaller) to help evenly propagate the folding along the scores and induce the formation of the bowl. Spaced apart from discontinuity 210 is an optional longitudinal linear score 215 that extends from a point at or near the discontinuity 210 (though in some implementations it may extend past discontinuity 210) to the rear of the handle region along a fold line. A die to produce the scoring pattern of FIG. 2 is more economical to produce and can provide millions more impressions which greatly reduces the unit/cost of the constructible utensil. Further, the scoring pattern of FIG. 2 results in a more predictable uniform bending/folding about scores 205 when the handle region is folded about the longitudinal axis that lengthwise divides constructible utensil 200 into 2 substantially symmetric halves. Constructible utensil 200 provides the fold line co-aligned with the longitudinal axis, however some implementations may not include this property.

Also identified in FIG. 2 are score termination locations 220 identifying places where scores 205 terminate on bowl portion of constructible utensil 200. Termination locations 220 may be at the very lateral edge of constructible utensil 200 or offset inboard a small distance. A reference line 225 extends between termination locations 220 and is further explained in connection with FIG. 4-FIG. 7 herein, it being understood that reference line 225 is not a printed/embossed score and is not visible on a constructible utensil.

Discontinuity 210 is offset from an edge of a handle portion of constructible utensil 200. When constructible utensil has width of 1.25 inches and an overall length of 3.25 inches, an offset distance of discontinuity 210 has two configurations: a first configuration in which the offset distance is at least 0.5 inches (may be longer) and a second configuration in which the offset distance is less than 0.5 inches. Optional longitudinal linear score 215 begins at or very near the edge of the handle portion and extends towards the bowl-region at the opposite end, and as shown in one embodiment, linear score 215 terminates before reaching discontinuity 210, though in some instances it may advance further along the fold line and meet or pass discontinuity 210.

Figure 3:
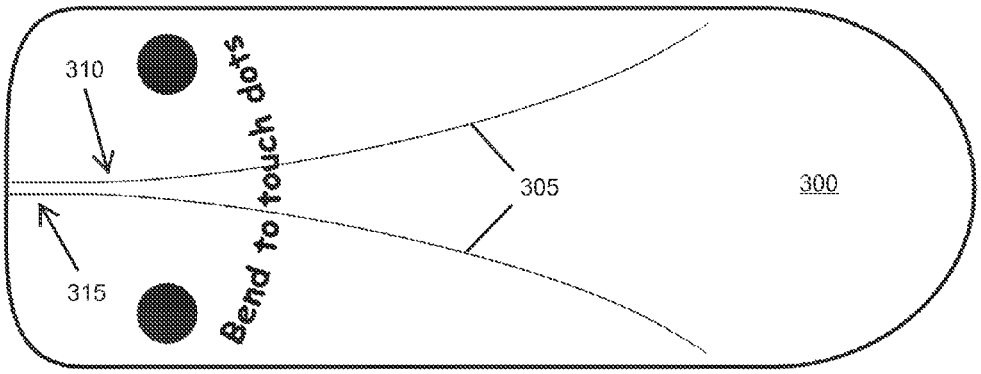
FIG. 3 illustrates a constructible utensil including a second improved scoring pattern.

FIG. 3 illustrates a constructible utensil 300 including a second improved scoring pattern. Utensil 300 includes a pair of scores 305, which may be curved as shown but are not required to be such, that are shaped to converge when moving from a bowl-region towards the handle portion. However in contrast to FIG. 1, scores 305 do not intersect but turn at inflection points 310 in the score pattern. The scores continue from each inflection point 310 and produce parallel linear score portions 315 that extend from inflection points 310 to the rear of the handle region. Linear score portions 315 are, in the preferred embodiments, parallel to the longitudinal axis and slightly offset an equal amount. A die to produce the scoring pattern of FIG. 3 is more economical to produce and can provide millions more impressions which greatly reduces the unit/cost of the constructible utensil. Further, the scoring pattern of FIG. 3 results in a more predictable uniform bending/folding about scores 305 when the handle region is folded about the longitudinal axis that lengthwise divides utensil 300 into 2 substantially symmetric halves.

A length of linear score portions 315 from inflection points 310 to the rear of the handle region may be separated into the two configurations of 0.5 inches or longer or shorter than 0.5 inches.

The embodiments of FIG. 1-FIG. 3 are useful with a wide range of substances, including foodstuff. In some implementations and uses, a user desires to use a constructible utensil with a substance that is relatively hard and fairly unyielding, particularly to paperboard constructible utensils. For example, "hard serve" ice cream is one such substance. In the event that a constructible utensil shaped and patterned similarly to the utensils of FIG. 1-FIG. 3 is used in an effort to "scoop" hard serve ice cream, the utensil has a propensity for the bowl portion (i.e., the region around bend line 225 and the area forward from there) to yield along bend line 225. Bending along bend line 225 makes constructible utensils similar to those of FIG. 1-FIG. 3 less desirable for such applications. The alternative embodiments of FIG. 4-FIG. 7 are configured to be better suited for scooping hard serve ice cream and other scoopable/spoonable substances that are problematic for the embodiments illustrated in FIG. 1-FIG. 3 due to bending about bend line 225.

Figure 4:
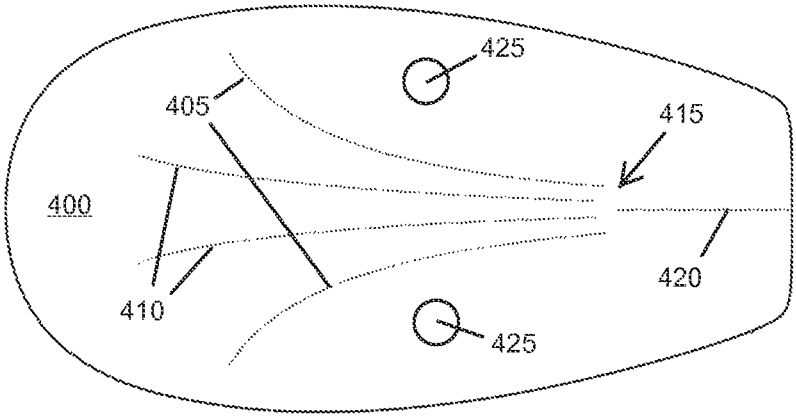
FIG. 4 illustrates a first alternative constructible utensil including a first improved scoring pattern.

FIG. 4 illustrates an alternative constructible utensil 400 including a first improved scoring pattern. Utensil 400 includes an outer pair of scores 405 and an inner pair of scores 410, which may be curved as shown but one or both pairs are not required to be such (e.g., a series of linear segments may create a jagged "curved" path), that are shaped to converge when moving from a bowl-region towards the handle portion. Outer scores 405 and inner scores 410 do not intersect but stop and produce a discontinuity 415 in the score pattern. Inner scores 410 extend further onto the bowl portion than outer scores 405, with inner scores 410 crossing a bend line of outer scores 405. Spaced apart from discontinuity 415 is a longitudinal linear score 420 that extends from discontinuity 415 to the rear of the handle region. Linear score 420 may extend completely to the rear edge or may terminate close to, but inboard, of the rear edge of the handle portion. In some implementations, linear score 420 may extend even with one or more of discontinuity 415, or may extend past them as it approaches the bowl-region. Discontinuity 415 of outer scores 405 and inner scores 410 may align along the longitudinal/fold axis or one discontinuity 415 may be shifted forward or back relative to the other. In FIG. 4, discontinuity 415 of outer score 405 is shifted back.

Figure 5:
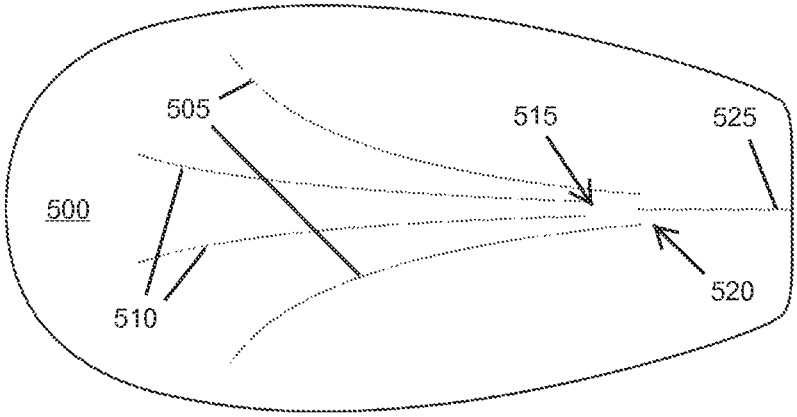
FIG. 5 illustrates the first alternative constructible utensil including a second improved scoring pattern.
Figure 6:
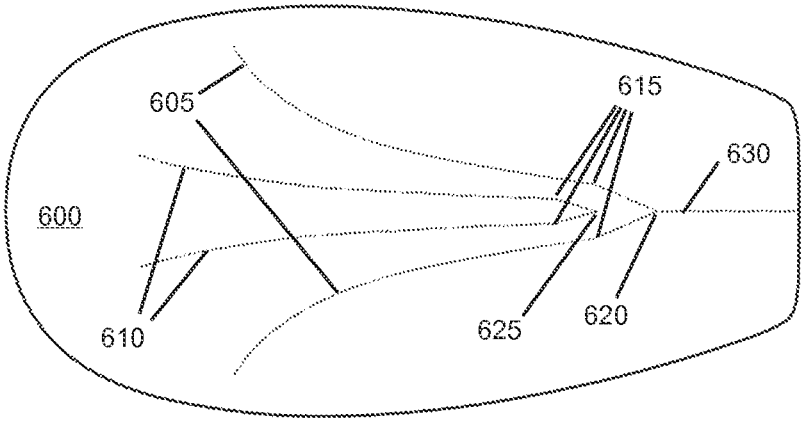
FIG. 6 illustrates the first alternative constructible utensil including a third improved scoring pattern.
Figure 7:
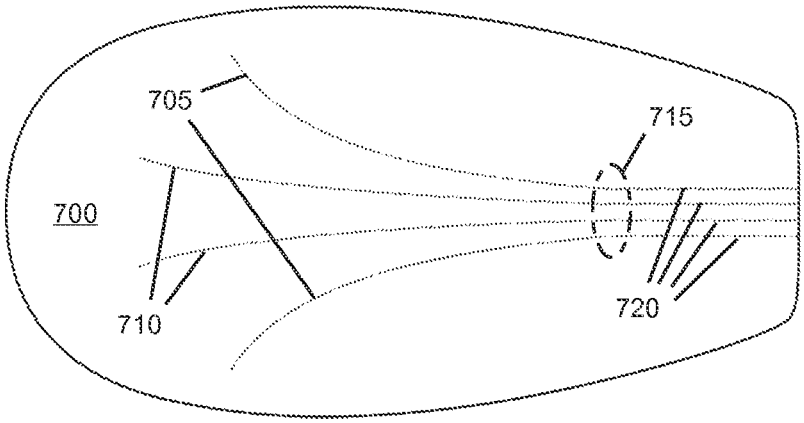
FIG. 7 illustrates the first alternative constructible utensil including a fourth improved scoring pattern.

In contrast to the constructible utensils of FIG. 1-FIG. 3, utensil 400 includes a pair of user bend-reference "dots" 425 disposed towards a middle portion (located between the bowl and the handle and symmetric with respect to a longitudinal axis running between the bowl and the handle). Also, a "waist" portion of the body of constructible utensil 400 is wider (e.g., lateral free edge bows outward as compared to a width of the ends), particularly at the bowl portion with the distal end (at the bowl portion) being blunter, as compared to the implementations of FIG. 1-FIG. 3. In one implementation, constructible utensil 400 is approximately 2.85" inches long and about 1.46" wide at the widest portion towards the middle. The handle area may be more tapered than the bowl region (as shown) to help reduce the amount of foundation material (e.g., paperboard stock) used. This perimeter profile, with bend-reference dots 425 positioned as shown, helps to create a constructible utensil 400 (when constructed by folding lateral edges together about the longitudinal axis to touch bend-reference dots 425 together and producing a complex bowl in the bowl region) that is better configured to scoop hard serve ice cream (including resistance to folding of the bowl portion). The inner scores 410 resist formation of the bend line that can be present in some FIG. 1-FIG. 3 implementations. While the embodiments of FIG. 5-FIG. 7 are not explicitly shown with reference dots, they may be placed and used as described as set forth in the discussion of FIG. 4.

With respect to the reference dots, placement is important as the foundation material of many implementations has sufficient stiffness to resist folding and the portions of the lateral edges that are actually touched and squeezed together are the closest together. Further away from the touching and squeezing, the lateral edges are further apart and less "folded" than is the case at the point of touching and squeezing. The constructed shape of the utensil formed from touching and squeezing is influenced by the location of this touching and squeezing, for example a depth and strength of the constructed bowl as the fold propagated from the squeezing is more extensive the closer the touching and squeezing is to the bowl-region and the various curve segments of the curved score. Further back the curve segments are more parallel to the longitudinal axis and touching squeezing in this region may produce a shallower bowl than touching and squeezing in the region where the curve segments are more perpendicular to the longitudinal axis which may produce deeper bowls.

Some embodiments may include a score termination on the handle portion that more closely matches the arrangement of FIG. 1 wherein some or all the scores smoothly meet without the discontinuity, and which may continue as a single longitudinal handle score when a converge point is displaced inward of an end of the handle portion.

A die to produce the scoring pattern of FIG. 4 can be more economical to produce and can provide millions more impressions which greatly reduces the unit/cost of the constructible utensil, particularly when manufactured on a high-speed rotary printing press. Further, the scoring pattern of FIG. 4 results in a more predictable uniform bending/folding about scores 405 and scores 410 when the handle region is folded about the longitudinal axis. The resulting constructed constructible utensil 400 (which can be nearly cylindrical in some implementations) is better suited for scooping harder substances such as hard serve ice cream. In some implementations, the "scooper" may release the fold after scooping and before handing constructible utensil 400 to the consumer to allow the constructed constructible utensil 400 to unfold/unroll. The unfolding/unrolling can provide a better consumption configuration than the sharply curled scooping configuration. Constructible utensil 400 supports such use.

FIG. 5 illustrates the alternative constructible utensil 500 including a second improved scoring pattern. Utensil 500 includes an outer pair of scores 505 and an inner pair of scores 510, which may be curved as shown but one or both pairs are not required to be such, that are shaped to converge when moving from a bowl-region towards the handle portion. Outer scores 505 and inner scores 510 do not intersect but stop and produce a first discontinuity 515 and a second discontinuity 520 in the score pattern. Outer scores 505 terminate at second discontinuity 520 further towards the end of the handle while inner scores 510 terminate at first discontinuity 515 that is closer to the bowl region than second discontinuity 520. In some embodiments this is changed, for example outer scores 505 terminate at a longitudinal location of first discontinuity 515 and inner scores 510 terminate at a longitudinal location of second discontinuity 520. In still other embodiments, one inner score and one outer score terminate at each discontinuity. Inner scores 510 extend further onto the bowl portion than outer scores 505, with inner scores 510 crossing what could be a bend line of outer scores 505 but for the placement/ arrangement of inner scores 510. Spaced apart from first discontinuity 515 (and approximately even with second discontinuity 520) is a longitudinal linear score 525 that extends from second discontinuity 520 to the rear of the handle region. Linear score 525 may extend completely to the edge or may terminate close to, but inboard, of the rear edge of the handle.

In some implementations, there may be a greater longitudinal separation from second discontinuity 520 and a beginning of longitudinal linear score 525 or more of an overlap of second discontinuity 520 with the beginning of longitudinal linear score 525. In other respects unless the context indicates otherwise, utensil 500 is similar to utensil 400 in size, construction, and operation.

A die to produce the scoring pattern of FIG. 5 can be more economical to produce and can provide millions more impressions which greatly reduces the unit/cost of the constructible utensil, particularly when manufactured on a high-speed rotary printing press. Further, the scoring pattern of FIG. 5 results in a more predictable uniform bending/folding about scores 505 and scores 510 when the handle region is folded about the longitudinal axis. The resulting constructed constructible utensil 500 (which can be nearly cylindrical in some implementations) is better suited for scooping harder substances such as hard serve ice cream. In some implementations, the "scooper" may release the fold after scooping and before handing constructible utensil 500 to the consumer to allow the constructed constructible utensil 500 to unfold/unroll. The unfolding/unrolling can provide a better consumption configuration than the sharply curled scooping configuration. Constructible utensil 500 supports such use.

FIG. 6 illustrates an alternative constructible utensil 600 including a third improved scoring pattern. Utensil 600 includes an outer pair of scores 605 and an inner pair of scores 610, which may be curved as shown but one or both pairs are not required to be such, that are shaped to converge when moving from a bowl-region towards the handle portion. Outer scores 605 and inner scores 610 do not actually converge, but the convergence curves terminate early at a set of points of inflection 615. The scores continue from the points of inflection using short score segments (that may be linear as shown or curved or some combination), with outer scores 605 intersecting at a first location 620 on the longitudinal axis and inner scores 610 intersecting at a second location 625 on the longitudinal axis. Inner scores 610 extend further onto the bowl portion than outer scores 605, with inner scores 610 crossing a bend line of outer scores 605. Extending from first location 620 is a longitudinal linear score 630 that extends from first location 620 to the rear of the handle region. Linear score 630 may extend completely to the edge or may terminate close to, but inboard, of the rear edge of the handle.

The score pattern of FIG. 6, while superficially similar to the score pattern of FIG. 1, is very different and provides an opportunity to help better explain some of the illustrated embodiments. In FIG. 1, two curved scores not only meet, but merge and continue. While this pattern may be reproduced using a sheet-fed printing process because the dies used are different from a rotary process, the die is able to define the meeting, merging, and continuing score pattern. In contrast, the pattern of FIG. 6 is made from multiple blade elements of the die. The linear segments extending from the inflection points to the intersecting points are formed from one or more blade elements that are independent from a blade element that defines linear score 630. In this way, the set of blade elements collectively define a manufacturable constructible utensil that offers performs similarly to the pattern of FIG. 1 when manufactured on a cost-effective rotary press.

In some implementations, there may be a different magnitude of longitudinal separation between the longitudinal locations. In some implementations, an incidence angle of the short score segments with respect to the longitudinal axis may vary when connecting to the respective inflection point. In other respects unless the context indicates otherwise, utensil 600 is similar to utensil 400 in size, construction, and operation.

A die to produce the scoring pattern of FIG. 6 can be more economical to produce and can provide millions more impressions which greatly reduces the unit/cost of the constructible utensil, particularly when manufactured on a high-speed rotary printing press. Further, the scoring pattern of FIG. 6 results in a more predictable uniform bending/folding about scores 605 and scores 610 when the handle region is folded about the longitudinal axis. The resulting constructed constructible utensil 600 (which can be nearly cylindrical in some implementations) is better suited for scooping harder substances such as hard serve ice cream. In some implementations, the "scooper" may release the fold after scooping and before handing constructible utensil 600 to the consumer to allow the constructed constructible utensil 600 to unfold/unroll. The unfolding/unrolling can provide a better consumption configuration than the sharply curled scooping configuration. Constructible utensil 600 supports such use.

FIG. 7 illustrates the alternative constructible utensil including a fourth improved scoring pattern. Utensil 700 includes an outer pair of scores 705 and an inner pair of scores 710, which may be curved as shown but one or both pairs are not required to be such, that are shaped to converge when moving from a bowl-region towards the handle portion. Outer scores 705 and inner scores 710 do not intersect as they turn at inflection points 715 (enclosed in the dashed ellipse) in the score pattern. Inner scores 710 extend further onto the bowl portion than outer scores 705, with inner scores 710 crossing a bend line of outer scores 705 which may exist but for inner scores 710 extending further onto the bowl portion. Inflection points 715 identify a change in trajectory of the scores as they change from a converging trajectory to a parallel trajectory. The scores continue from each inflection point 715 and produce parallel linear score portions 720 that extend from inflection points 715 to the rear of the handle region. Linear score portions 720 are, in the preferred embodiments, parallel to the longitudinal axis and slightly offset and spaced an equal amount. Linear score portions 720 may extend completely to the edge or may terminate close to, but inboard, of the rear edge of the handle.

In some implementations, there may be a greater longitudinal separation between inflection points 715 and the rear of the handle portion (which typically changes the spacing of parallel score portions 720. In other respects unless the context indicates otherwise, utensil 700 is similar to utensil 400 in size, construction, and operation.

A die to produce the scoring pattern of FIG. 7 can be more economical to produce and can provide millions more impressions which greatly reduces the unit/cost of the constructible utensil, particularly when manufactured on a high-speed rotary printing press. Further, the scoring pattern of FIG. 7 results in a more predictable uniform bending/folding about scores 705 and scores 710 when the handle region is folded about the longitudinal axis. The resulting constructed constructible utensil 700 (which can be nearly cylindrical in some implementations) is better suited for scooping harder substances such as hard serve ice cream. In some implementations, the "scooper" may release the fold after scooping and before handing constructible utensil 700 to the consumer to allow the constructed constructible utensil 700 to unfold/ unroll. The unfolding/unrolling can provide a better consumption configuration than the sharply curled scooping configuration. Constructible utensil 700 supports such use.

Figure 8:
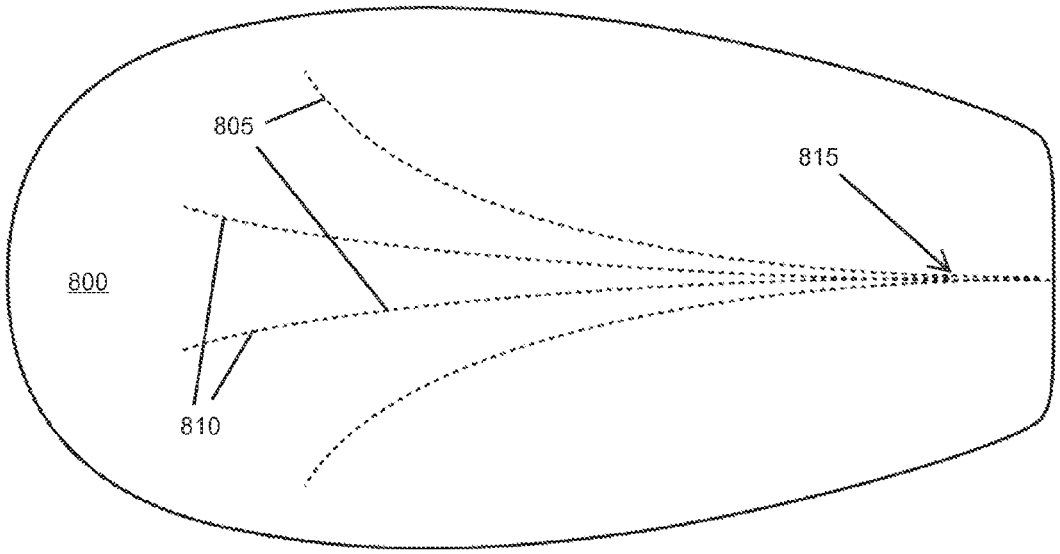
FIG. 8 illustrates the first alternative constructible utensil including a fifth improved scoring pattern.

FIG. 8 illustrates the alternative constructible utensil including a fifth improved scoring pattern. Utensil 800 includes an outer pair of scores 805 and an inner pair of scores 810, which may be curved as shown but one or both pairs are not required to be such, that are shaped to converge when moving from a bowl-region towards the handle portion. Outer scores 805 and inner scores 810 begin to intersect as they converge to a central longitudinal score 815, about which utensil 800 is approximately symmetric. Inner scores 810 extend further onto the bowl portion than outer scores 805, with inner scores 810 crossing a bend line of outer scores 805. Longitudinal score 815 may extend completely to the edge or may terminate close to, but inboard, of the rear edge of the handle.

In some implementations, there may be a sharper, or shallower, convergence as outer scores 805 and inner scores 810 approach the rear of the handle portion. In other respects unless the context indicates otherwise, utensil 800 is similar to utensil 400 in size, construction, and operation. Like the pattern of FIG. 6, the pattern illustrated in FIG. 8 does not suffer the same disadvantages as the pattern of FIG. 1 in that the score patterns do not continue after intersecting/merging. The dies of high-speed rotary press are able to reproduce converging/intersecting scores as long as they do not continue past the merger/intersection. The pattern of FIG. 8 meet and intersect but do not continue. Instead of continuing, an independent element would be made available on the die to add the continuing element in the scoring pattern rather than extend the same blade element(s) producing the meeting and converging scores to add the continued segment as well.

A die to produce the scoring pattern of FIG. 8 can be more economical to produce and can provide millions more impressions which greatly reduces the unit/cost of the constructible utensil, particularly when manufactured on a high-speed rotary printing press. Further, the scoring pattern of FIG. 8 results in a more predictable uniform bending/folding about scores 805 and scores 810 when the handle region is folded about the longitudinal axis. The resulting constructed constructible utensil 800 (which can be nearly cylindrical in some implementations) is better suited for scooping harder substances such as hard serve ice cream. In some implementations, the "scooper" may release the fold after scooping and before handing constructible utensil 800 to the consumer to allow the constructed constructible utensil 800 to unfold/unroll. The unfolding/unrolling can provide a better consumption configuration than the sharply curled scooping configuration. Constructible utensil 800 supports such use.

As noted herein, some alternative scoring patterns have variation as to off-axis lateral displacement of scores on the handle portion of the constructible utensils. As the number and spacing of scores across the lateral width of the handle portion increases, a strength of the handle portion increases.

The constructible utensils of FIG. 4-FIG. 8 include inner scores and outer scores. In embodiments of the present invention, the outer scores are curved to intersect a lateral edge at, or near a bowl portion while the inner scores have a trajectory that extends to the end/tip of the bowl. In these embodiments, the termination points of the scores on the bowl portion are spaced away from the edge. These, and the other disclosed parameters, improve the ability of these utensils to sample hard substances that can otherwise cause other constructible utensils to fail in this and related applications. Some embodiments will use a C2S 16 point caliper cold cup paperboard stock or the like. They may include a moisture barrier (e.g., a coating) to help resist moisture deterioration of the utensil during use.

FIG. 9 through FIG. 14 illustrate a class of embodiment configured for use as a "spoon lid" that includes a body having a handle portion shaped to complement a top (or bottom) of a food container or the like and a scoop, or bowl, portion that unfolds and extends to transform the structure from a compact form for co-packing with foodstuff to an operational form for consuming the foodstuff. U.S. Pat. No. 8,2010,381 to Cross provides background for this configuration, this patent hereby expressly incorporated by reference thereto in its entirety for all purposes. The embodiments described herein include descriptions of improved patterning features allowing for enhanced manufacturability and cost-reduced implementations.

Figure 9:
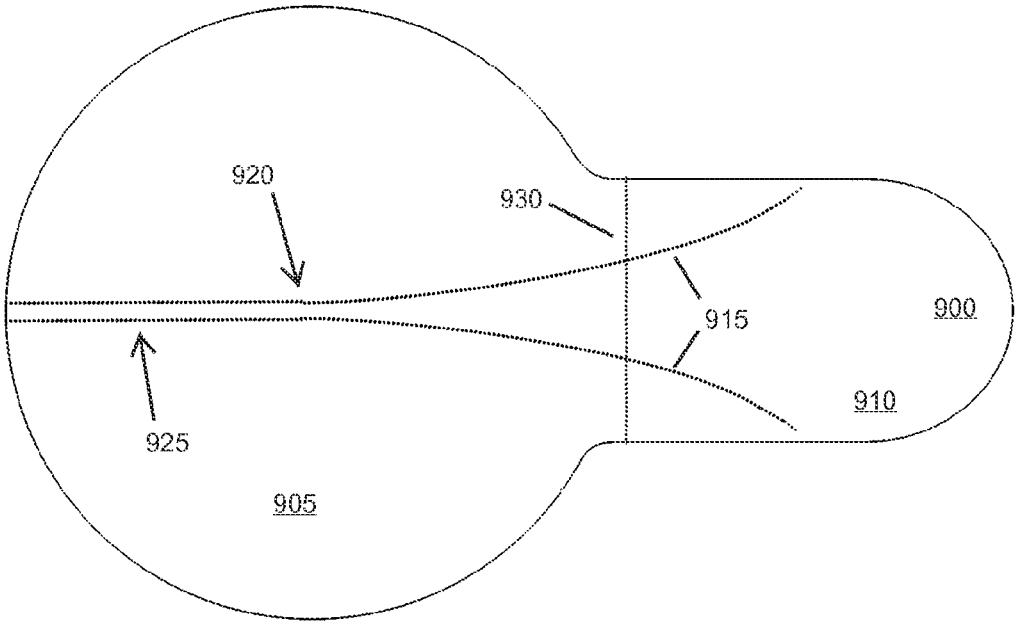
FIG. 9 illustrates a second alternative constructible utensil including a first improved scoring pattern.

FIG. 9 illustrates a second alternative constructible utensil 900 including a first improved scoring pattern. The first improved scoring pattern of utensil 900 is similar to the scoring pattern of FIG. 3 except for the arrangement of a perimeter of utensil 900 and disposition of the scoring pattern on a handle region 905 and a scoop portion 910. Utensil 900 includes a pair of scores 915, which may be curved as shown but are not required to be such, that are shaped to converge when moving from scoop portion 910 towards handle region 905. Like utensil 300, scores 915 do not intersect but turn at inflection points 920 in the score pattern. The scores continue from each inflection point 920 and produce parallel linear score portions 925 that extend from inflection points 920 to the rear of handle region 905. Linear score portions 925 are, in the preferred embodiments, parallel to the longitudinal axis and slightly offset therefrom an equal amount (utensil 900 is generally symmetric about the longitudinal axis). A die to produce the scoring pattern of FIG. 9 is more economical to produce and can provide millions more impressions which greatly reduces the unit/cost of the constructible utensil. Further, the scoring pattern of FIG. 9 results in a more predictable uniform bending/folding about scores 915 when handle region 905 is folded about the longitudinal axis and induces a lengthwise distortion propagated by the scoring pattern to create a three-dimensional bowl in scoop portion 910.

Utensil 900 includes a lateral fold score 930 that in the disclosed embodiments is shown as substantially perpendicular to the longitudinal axis and located on scoop portion 910. Scores 915 cross lateral fold score 930. In other embodiments, lateral fold score 930 may not be on scoop portion but disposed on handle region 905. Further, lateral fold score 930 may not be perpendicular to the longitudinal axis but may have some angle relative to the longitudinal axis. One or more individual scores of scores 915 cross lateral fold score 930. When deformation of utensil 900 about the longitudinal axis propagates a bowl-developing distortion in the otherwise flat/planar constructible utensil, the bowl-developing distortion follows along scores 915. This distortion, when crossing lateral fold score 930, strengthens and supports that portion of utensil 900 extending past to resist folding after construction. Lateral fold score 930 permits folding a portion of utensil 900 for compactness and packaging/delivery to a consumer. Placement and arrangement of scores 915 overcome the "foldiness" of utensil 900 about lateral fold score 930 when utensil 900 is constructed to provide a sturdy and robust extended constructed utensil that is suitable for consuming foodstuff without having scoop portion 910 prematurely fold and drop its load during use. Utensil 900 has two perimeters—a first perimeter is shaped for compactness when folded about lateral fold score 930 and is complementary to a perimeter of an associated foodstuff container (such as a lid, bottom, side, or the like). Advantageously this configuration is used when the unfolded second perimeter would have a component extending beyond one of the associated container's dimensions.

"Spoon lid" type arrangements and configurations are often larger than the implementations for "tasting" (such as versions of the implementations illustrated in FIG. 1-FIG. 8) and have an improved change of being able to be economically manufactured using sheet-fed die cutting methods as described herein. In those instances, there is less risk to the die which thus increases the value of the improved foldability of the score pattern aspect of the disclosed invention to Spoon Lids and other larger constructible utensils.

Figure 10:
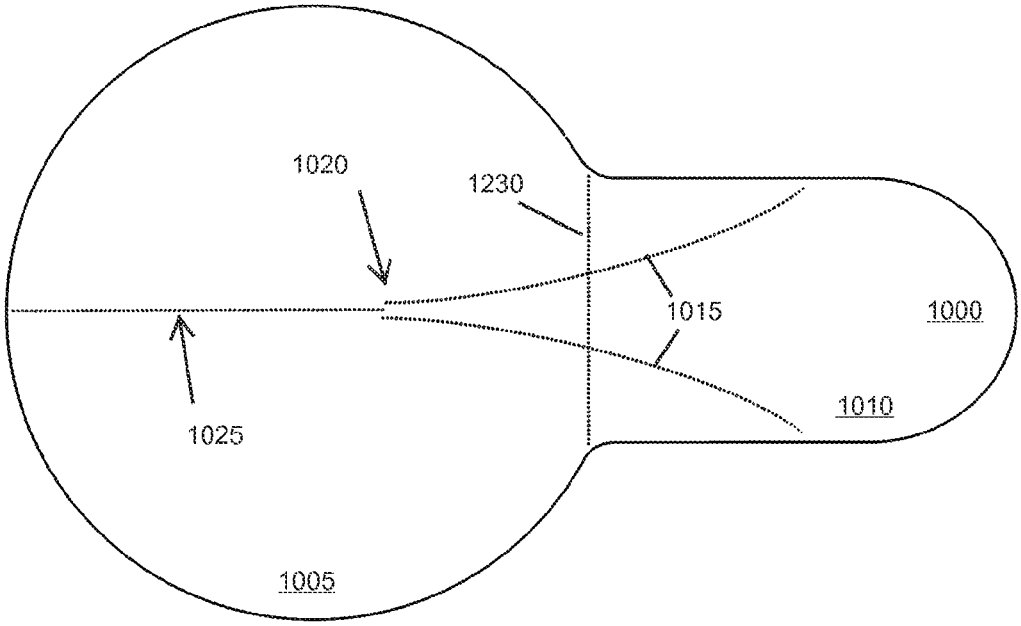
FIG. 10 illustrates a second alternative constructible utensil including a second improved scoring pattern.

FIG. 10 illustrates a second alternative constructible utensil 1000 including a second improved scoring pattern. Utensil 1000 is similar in construction and operation to that of utensil 900 except for the differences in the scoring identified herein, which are similar in arrangement and operation as the scoring pattern illustrated in FIG. 2 except for the arrangement of a perimeter of utensil 1000 and disposition of the scoring pattern on a handle region 1005 and a scoop portion 1010. Utensil 1000 includes a pair of scores 1015, which may be curved as shown but are not required to be such, that are shaped to converge when moving from scoop portion 1010 towards handle region 1005. Like constructible utensil 200, scores 1015 do not intersect but terminate at inflection points 1020 in the score pattern. A linear longitudinal score 1025 extends from a point at or near inflection points 1020 to the rear of handle region 1005. Linear longitudinal score 1025 is, in the preferred embodiments, coaxial with the longitudinal axis (utensil 1000 is generally symmetric about the longitudinal axis). A die to produce the scoring pattern of FIG. 10 is more economical to produce and can provide millions more impressions which greatly reduces the unit/cost of the constructible utensil. Further, the scoring pattern of FIG. 10 results in a more predictable uniform bending/folding about scores 1015 when handle region 1005 is folded about the longitudinal axis and induces a lengthwise distortion propagated by the scoring pattern to create a three-dimensional bowl in scoop portion 1010.

Utensil 1000 includes a lateral fold score 1030 that in the disclosed embodiments is shown as substantially perpendicular to the longitudinal axis and located proximate a junction of handle region 1005 and scoop portion 1010. Scores 1015 cross lateral fold score 1030. In other embodiments, lateral fold score 1030 may be on handle region 1005 or scoop portion 1010. Further, lateral fold score 1030 may not be perpendicular to the longitudinal axis but may have some angle relative to the longitudinal axis. One or more individual scores of scores 1015 cross lateral fold score 1030. When deformation of utensil 1000 about the longitudinal axis propagates a bowl-developing distortion in the otherwise flat/planar constructible utensil, the bowl-developing distortion follows along scores 1015. This distortion, when crossing lateral fold score 1030, strengthens and supports that portion of utensil 1000 extending past to resist folding after construction. Lateral fold score 1030 permits folding a portion of utensil 1000 for compactness and packaging/delivery to a consumer. Placement and arrangement of scores 1015 overcome the "foldiness" of utensil 1000 about lateral fold score 1030 when utensil 1000 is constructed to provide a sturdy and robust extended constructed utensil that is suitable for consuming foodstuff without having scoop portion 1010 prematurely fold and drop its load during use. Utensil 1000 has two perimeters—a first perimeter is shaped for compactness when folded about lateral fold score 1030 and is complementary to a perimeter of an associated foodstuff container (such as a lid, bottom, side, or the like). Advantageously this configuration is used when the unfolded second perimeter would have a component extending beyond one of the associated container's dimensions.

Figure 11:
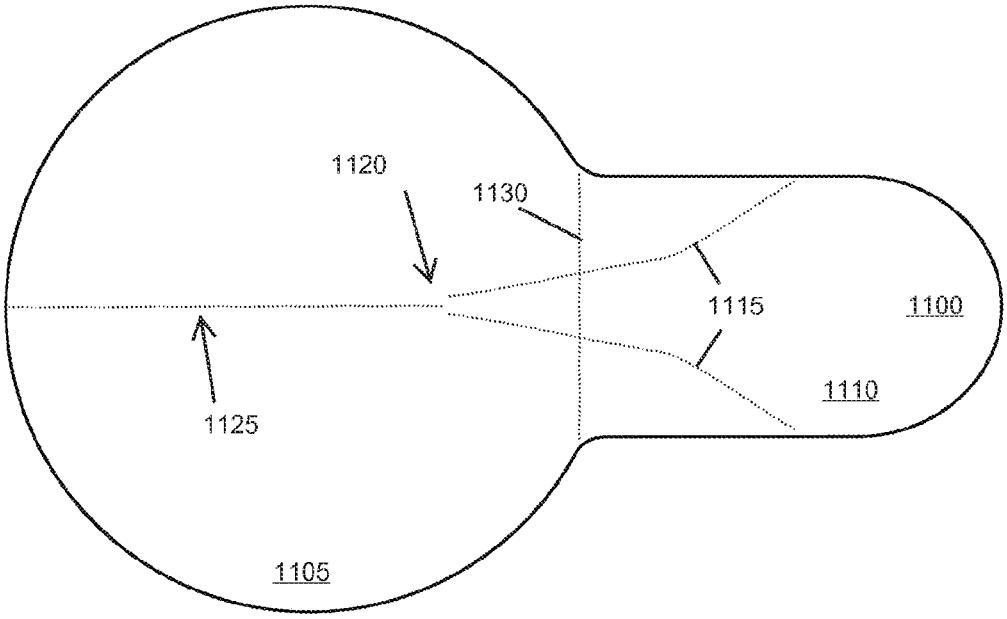
FIG. 11 illustrates a second alternative constructible utensil including a third improved scoring pattern.

FIG. 11 illustrates a second alternative constructible utensil 1100 including a third improved scoring pattern. Utensil 1100 is similar in construction and operation to that of utensil 1000 except for the differences in the scoring identified herein, which are similar in arrangement and operation as the scoring pattern illustrated in FIG. 10 except for the arrangement of scores 1015. Utensil 1100 includes a pair of scores 1115, which may be a series of straight line segments as shown but are not required to be such (e.g., rather than 2 linear segments per score, there could be a greater number of score segments), that are shaped to converge when moving from scoop portion 1110 towards handle region 1105. Like utensil 1000, scores 1115 do not intersect but terminate at inflection points 1120 in the score pattern. A linear longitudinal score 1125 extends from a point at or near inflection points 1120 to the rear of handle region 1105. Linear longitudinal score 1125 is, in the preferred embodiments, coaxial with the longitudinal axis (utensil 1100 is generally symmetric about the longitudinal axis). A die to produce the scoring pattern of FIG. 11 is more economical to produce and can provide millions more impressions which greatly reduces the unit/cost of the constructible utensil. Further, the scoring pattern of FIG. 11 results in a more predictable uniform bending/folding about scores 1115 when handle region 1105 is folded about the longitudinal axis and induces a lengthwise distortion propagated by the scoring pattern to create a three-dimensional bowl in scoop portion 1110.

Utensil 1100 includes a lateral fold score 1130 that in the disclosed embodiments is shown as substantially perpendicular to the longitudinal axis and located proximate a junction of handle region 1105 and scoop portion 1110. Scores 1115 cross lateral fold score 1130. In other embodiments, lateral fold score 1130 may be on handle region 1105 or scoop portion 1110. Further, lateral fold score 1130 may not be perpendicular to the longitudinal axis but may have some angle relative to the longitudinal axis. One or more individual scores of scores 1115 cross lateral fold score 1130. When deformation of utensil 1100 about the longitudinal axis propagates a bowl-developing distortion in the otherwise flat/planar constructible utensil, the bowl-developing distortion follows along scores 1115. This distortion, when crossing lateral fold score 1130, strengthens and supports that portion of utensil 1100 extending past to resist folding after construction. Lateral fold score 1130 permits folding a portion of utensil 1100 for compactness and packaging/delivery to a consumer. Placement and arrangement of scores 1115 overcome the "foldiness" of utensil 1100 about lateral fold score 1130 when utensil 1100 is constructed to provide a sturdy and robust extended constructed utensil that is suitable for consuming foodstuff without having scoop portion 1110 prematurely fold and drop its load during use. Utensil 1100 has two perimeters—a first perimeter is shaped for compactness when folded about lateral fold score 1130 and is complementary to a perimeter of an associated foodstuff container (such as a lid, bottom, side, or the like). Advantageously this configuration is used when the unfolded second perimeter would have a component extending beyond one of the associated container's dimensions.

Figure 12:
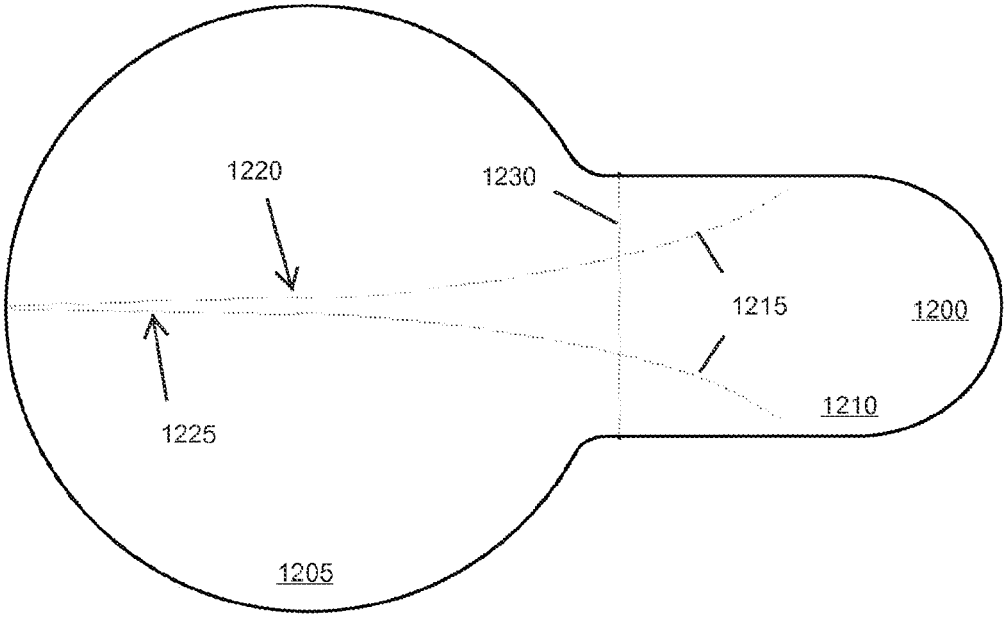
FIG. 12 illustrates a second alternative constructible utensil including a fourth improved scoring pattern.

FIG. 12 illustrates a second alternative constructible utensil 1200 including a fourth improved scoring pattern. Utensil 1200 is similar in construction and operation to that of utensil 900 except for the differences in the scoring identified herein. Utensil 1200 includes a pair of scores 1215, which may be smoothly curved as shown but are not required to be such (e.g., some embodiments may be implemented as 2 or more linear segments per score similar to FIG. 11), that are shaped to converge when moving from scoop portion 1210 towards handle region 1205. Like utensil 900, scores 1215 do not intersect but change direction at inflection points 1220 in the score pattern. A pair of linear converging scores 1225 extends from each inflection point 1220 to the rear of handle region 1205. Linear converging scores 1225 are, in the preferred embodiments, symmetric about the longitudinal axis (utensil 1200 is generally symmetric about the longitudinal axis) and approach the longitudinal but remain spaced apart at an edge of handle region 1205 (in some implementations the linear converging scores do actually intersect).

A die to produce the scoring pattern of FIG. 12 is more economical to produce and can provide millions more impressions which greatly reduces the unit/cost of the constructible utensil. Further, the scoring pattern of FIG. 12 results in a more predictable uniform bending/folding about scores 1215 when handle region 1205 is folded about the longitudinal axis and induces a lengthwise distortion propagated by the scoring pattern to create a three-dimensional bowl in scoop portion 1210.

Utensil 1200 includes a lateral fold score 1230 that in the disclosed embodiments is shown as substantially perpendicular to the longitudinal axis and located on scoop portion 1210. Scores 1215 cross lateral fold score 1230. In other embodiments, lateral fold score 1230 may be on handle region 1205 or proximate a junction of handle region 1205 and scoop portion 1210. Further, lateral fold score 1230 may not be perpendicular to the longitudinal axis but may have some angle relative to the longitudinal axis. One or more individual scores of scores 1215 cross lateral fold score 1230. When deformation of utensil 1200 about the longitudinal axis propagates a bowl-developing distortion in the otherwise flat/planar constructible utensil, the bowl-developing distortion follows along scores 1215. This distortion, when crossing lateral fold score 1230, strengthens and supports that portion of utensil 1200 extending past to resist folding after construction. Lateral fold score 1230 permits folding a portion of utensil 1200 for compactness and packaging/delivery to a consumer. Placement and arrangement of scores 1215 overcome the "foldiness" of utensil 1200 about lateral fold score 1230 when utensil 1200 is constructed to provide a sturdy and robust extended constructed utensil that is suitable for consuming foodstuff without having scoop portion 1210 prematurely fold and drop its load during use. Utensil 1200 has two perimeters—a first perimeter is shaped for compactness when folded about lateral fold score 1230 and is complementary to a perimeter of an associated foodstuff container (such as a lid, bottom, side, or the like). Advantageously this configuration is used when the unfolded second perimeter would have a component extending beyond one of the associated container's dimensions.

Figure 13:
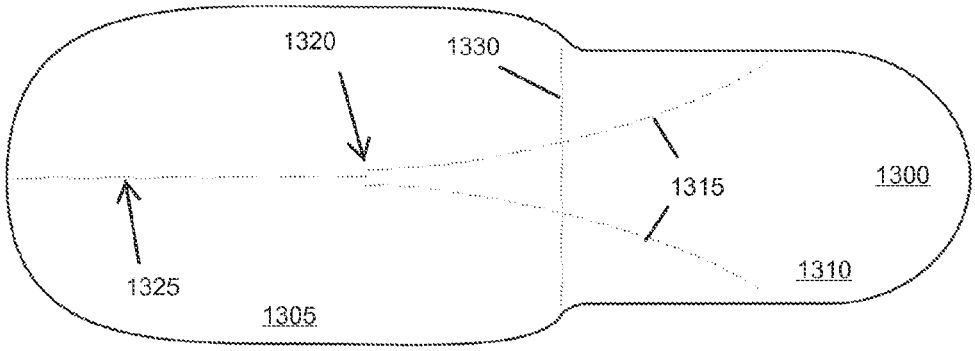
FIG. 13 illustrates a third alternative constructible utensil including a first improved scoring pattern.

FIG. 13 illustrates a third alternative constructible utensil 1300 including a first improved scoring pattern. Utensil 1300 is similar in construction and operation to that of utensil 1000 except for the differences in perimeter and disposition of the scoring pattern on a handle region 1305 and a scoop portion 1310. Utensil 1300 includes a pair of scores 1315, which may be curved as shown but are not required to be such, that are shaped to converge when moving from scoop portion 1310 towards handle region 1305. Like constructible utensil 200, scores 1315 do not intersect but terminate at inflection points 1320 in the score pattern. A linear longitudinal score 1325 extends from a point at or near inflection points 1320 to the rear of handle region 1305. Linear longitudinal score 1325 is, in the preferred embodiments, coaxial with the longitudinal axis (utensil 1300 is generally symmetric about the longitudinal axis). A die to produce the scoring pattern of FIG. 13 is more economical to produce and can provide millions more impressions which greatly reduces the unit/cost of the constructible utensil. Further, the scoring pattern of FIG. 13 results in a more predictable uniform bending/folding about scores 1315 when handle region 1305 is folded about the longitudinal axis and induces a lengthwise distortion propagated by the scoring pattern to create a three-dimensional bowl in scoop portion 1310.

Utensil 1300 includes a lateral fold score 1330 that in the disclosed embodiments is shown as substantially perpendicular to the longitudinal axis and located proximate a junction of handle region 1305 and scoop portion 1310. Scores 1315 cross lateral fold score 1330. In other embodiments, lateral fold score 1330 may be on handle region 1305 or scoop portion 1310. Further, lateral fold score 1330 may not be perpendicular to the longitudinal axis but may have some angle relative to the longitudinal axis. One or more individual scores of scores 1315 cross lateral fold score 1330. When deformation of utensil 1300 about the longitudinal axis propagates a bowl-developing distortion in the otherwise flat/planar constructible utensil, the bowl-developing distortion follows along scores 1315. This distortion, when crossing lateral fold score 1330, strengthens and supports that portion of utensil 1300 extending past to resist folding after construction. Lateral fold score 1330 permits folding a portion of utensil 1300 for compactness and packaging/delivery to a consumer. Placement and arrangement of scores 1315 overcome the "foldiness" of utensil 1300 about lateral fold score 1330 when utensil 1300 is constructed to provide a sturdy and robust extended constructed utensil that is suitable for consuming foodstuff without having scoop portion 1310 prematurely fold and drop its load during use. Utensil 1300 has two perimeters—a first perimeter is shaped for compactness when folded about lateral fold score 1330 and is complementary to a perimeter of an associated foodstuff container (such as a lid, bottom, side, or the like). Advantageously this configuration is used when the unfolded second perimeter would have a component extending beyond one of the associated container's dimensions.

Figure 14:
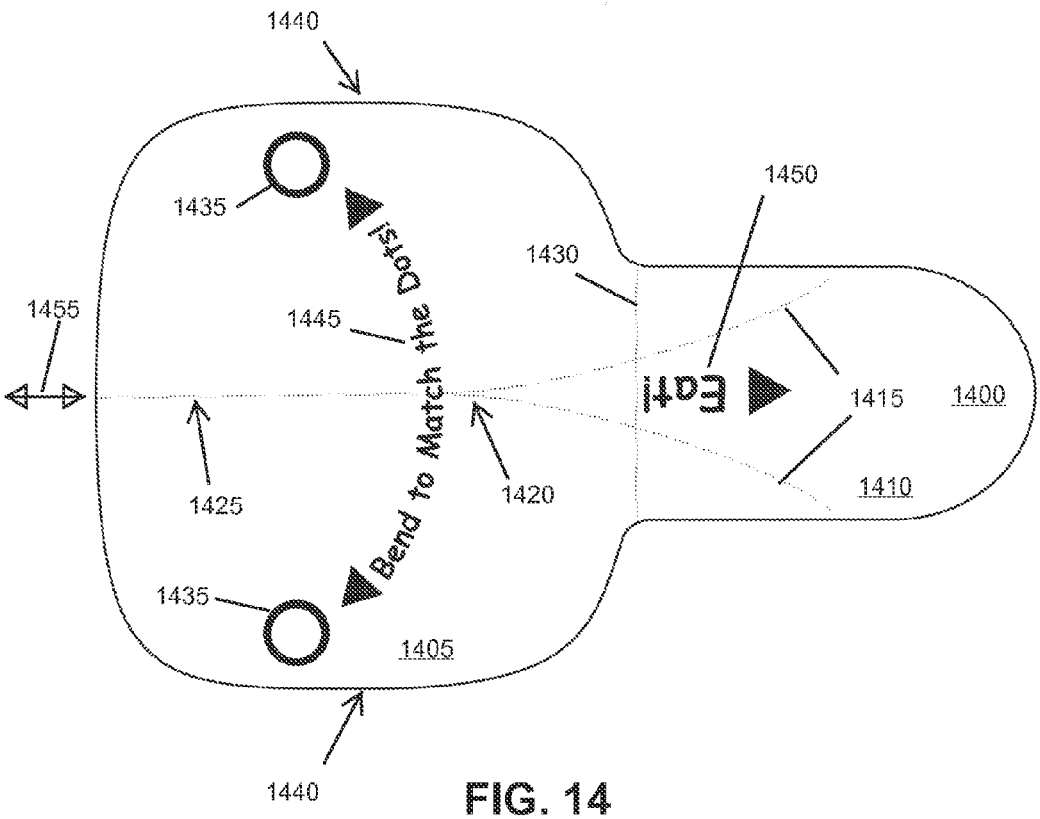
FIG. 14 illustrates a fourth alternative constructible utensil including a first improved scoring pattern.

FIG. 14 illustrates a fourth alternative constructible utensil 1400 including a scoring pattern. Utensil 1400 is similar in construction and operation to that of constructible utensil 100 except for the differences in perimeter and disposition of the scoring pattern on a handle region 1405 and a scoop portion 1410 and for the layout and arrangement of a set of directional indicia. Utensil 1400 includes a pair of scores 1415, which may be curved as shown but are not required to be such, that are shaped to converge when moving from scoop portion 1410 towards handle region 1405. Scores 1415 meet at an intersection 1420 and continue as a single straight score 1425. Typically, but not required, scores 1415 are symmetric about a longitudinal axis that extends from an edge of a handle to an edge of a bowl-forming region, the axis dividing utensil in two halves, often but not always these two halves are symmetric.

Utensil 1400 includes a lateral fold score 1430 that in the disclosed embodiments is shown as substantially perpendicular to the longitudinal axis and located on scoop portion 1410. Scores 1415 cross lateral fold score 1430. In other embodiments, lateral fold score 1430 may be on handle region 1405 or proximate a junction of handle region 1405 and scoop portion 1410. Further, lateral fold score 1430 may not be perpendicular to the longitudinal axis but may have some angle relative to the longitudinal axis. One or more individual scores of scores 1415 cross lateral fold score 1430. When deformation of utensil 1400 about the longitudinal axis propagates a bowl-developing distortion in the otherwise flat/planar constructible utensil, the bowl-developing distortion follows along scores 1415. This distortion, when crossing lateral fold score 1430, strengthens and supports that portion of utensil 1400 extending past to resist folding after construction. Lateral fold score 1430 permits folding a portion of utensil 1400 for compactness and packaging/delivery to a consumer. Placement and arrangement of scores 1415 overcome the "foldiness" of utensil 1400 about lateral fold score 1430 when utensil 1400 is constructed to provide a sturdy and robust extended constructed utensil that is suitable for consuming foodstuff without having scoop portion 1410 prematurely fold and drop its load during use. Utensil 1400 has two perimeters—a first perimeter is shaped for compactness when folded about lateral fold score 1430 and is complementary to a perimeter of an associated foodstuff container (such as a lid, bottom, side, or the like). Advantageously this configuration is used when the unfolded second perimeter would have a component extending beyond one of the associated container's dimensions.

The set of direction indicia of utensil 1400 includes a pair of touch references 1435 disposed towards lateral edges 1440 (typically symmetric about a fold axis that is also, typically, aligned with the longitudinal axis). Between touch references 1435 is a constructional text phrase 1445 that is bracketed by a pair of arrows that point to a proximate touch reference. Preferably constructional text phrase 1445 follows a curved text foundation path that extends between touch references 1435. The set of directional indicia of utensil 1400 further includes a consumption text reference 1450.

Touch references 1435 are visual elements helping a user to construct utensil 1400 by providing a target. Typically these constructible utensils are constructed by squeezing lateral edges 1440 between two fingers to fold about a fold axis 1455 (co-axial in this case with the longitudinal axis). Typically not appreciated by a user is that functional characteristics of constructed utensil 1400 are determined by the location where this squeezing/folding occurs. For example, the location helps to define the propagation and strength characteristic of the bowl that is formed. Part of this is due to a type of "hysteresis" in the planar body material in that only the portion that is squeezed together will touch or be closest to touching while regions of constructed utensil 1400 further away from the squeezed portion will be further from touching, the separation directly related to the distance away from the squeezed portion. Also, the location of the squeezed portion to the direction changes of the scores making up a curve can influence the shape of the curve produced by squeezing/folding. Depending upon the foodstuff or material associated with the utensil, the location of the touch references are tuned to help the user optimize the configuration of the constructed utensil and achieve a superior result than may be achieved by a user-selected squeeze location. Touch references 1435 identify a predetermined squeeze location that achieves the predetermined level of performance for the user. Touch references 1435 whether a circle, dot, graphic, or the like provide a visual cue for targeting the folding, while also suggesting that the way to fold and construct utensil 1400 is to place, for example, a forefinger at one touch reference 1435 and a thumb of the same hand at the other touch reference and fold utensil about fold axis 1455 to have the dots touch.

Many users understand construction of utensil 1400 naturally or with a small amount of suggestion from touch references 1435. Some users may require a bit more help, and constructional text phrase 1445 provides further assistance to these users by providing construction direction.

After construction, many users natively understand how to manipulate and use the constructed utensil. The user's hand that has folded utensil 1400 employs the part in the hand as the handle. By folding, a bowl has been produced in the scoop portion and the user is able to use the bowl to scoop foodstuff from the associated container and deliver it to the user's mouth. Some users may be unfamiliar with a constructible utensil in this format and it may be useful to provide them with additional cues, like consumption text reference 1450 to help the user understand how to operate a constructed utensil. For utensil 1400, having consumption text read "Eat!" and have a reference arrow point to the bowl is an example of helping these users. The set of direction indicia may be added to any of the embodiments shown in FIG. 2-FIG. 13.

In the embodiments of FIG. 9-FIG. 14, the handle region is typically the largest and is shaped to match a portion of the associated container. For example, in FIG. 9-FIG. 12, the folded first perimeter may match a top (or bottom) of a container having a circular lid (or bottom). A container that may be used with utensil 1300 may have a rectangular lid (or bottom or sidewall) and a container for use with utensil 1400 may include a rounded-square lid (or bottom or sidewall).

In FIG. 2-14, various score patterns are shown. A particular score pattern may be adapted to another embodiment, that is a score pattern of FIG. 12 may be used with and adapted for a constructible utensil perimeter shown in FIG. 2 or FIG. 4 (and the same being true for the other patterns used with other perimeters, it being understood that other perimeter shapes are possible beyond those illustrated and described herein). Further, the embodiments of FIG. 9-14 are illustrated with a lateral fold score. The embodiments of FIG. 2-FIG. 8 may also be provided with a lateral fold score as well, with the lateral fold score crossing the diverged portions of the score patterns.

Termination of the scores inboard of the actual perimeter edges is useful for constructible utensils that are coated with a moisture barrier or have a multi-ply structure with an exterior moisture barrier. When scores extend all the way to the edges in such configurations, the moisture-barrier properties may be degraded at the point where the score meets the perimeter edge. Maintaining the scores inboard better preserves the moisture-barrier properties at the end of the scores.

The disclosed constructible utensils have been described with specific patterns of particular numbers of scores arranged in particular ways. The present invention includes alternative embodiments, some of which will have odd numbers of scores (e.g., a central longitudinal score added to the embodiments described above), and some will have a greater or fewer number of scores, not all of which need be symmetric about the longitudinal axis.

In some of the embodiments disclosed herein, the term "discontinuity" has sometimes been used. For purposes of this specification, discontinuity refers to an interruption in a curve that approaches an alignment or a parallelism with another line or axis. It is not simply a termination point of a score, but a termination of a score having this particular arrangement to another structure or location. In this case, the discontinuity assists with production of certain production dies/plates used in the manufacturing process as noted herein without interfering with the propagation of a longitudinal fold which crosses the discontinuity to transfer the folding into the bowl-producing propagation along the off-axis scores.

Some manufacturers using high speed narrow web presses rely on a single die maker. Die plates to create converging score patterns may be challenging to produce and not all die makers may be up to production of the same quality of die plates for preparing die plates to produce the converging score pattern. The use of alternative score patterns that do not require convergence enable use of a wider range of printers/manufacturers.

In the present invention, there are few considerations bearing upon dimensions and scaling of a constructible utensil of the present invention. This discussion is provided in the context of constructible utensil 200 illustrated in FIG. 2 for conciseness, however the considerations are generally applicable. Constructible utensil 200 typically includes at least two overarching considerations: a functional effectiveness consideration and a length-influencing consideration. Functional effectiveness determines whether the utensil may be constructed and operated for the intended target market. This relates to the type of foodstuff (solid, semi-solid, frozen ice cream, and the like). Functional effectiveness follows from the components that define and shape the bowl-portion. How wide, sturdy, and deep the bowl is, for example. These are determined in part by the dimensions and perimeter shape of the front-portion of the constructible utensil as well as the layout and arrangement of the score pattern from discontinuity 210 forward to the bowl-portion.

The length-influencing consideration includes many potentially competing factors, competing sometimes not only with the functional effectiveness, but sometimes also amongst the individual factors. This is because some factors tend to reduce the overall length of the constructible utensil and some tend to increase its length. Length shortening factors include reduction in material use (common for taster implementations or other single-use applications), and packaging limitations. Some constructible utensils are packed along with a container (a yogurt container, a package of rice and beans, or other foodstuff) and the dimensions of the container can vary widely. In some cases, the constructible utensil must be made short in order to be conveniently associated with the container (e.g., within the lid, on the bottom or side of the container, or the like). The constructible utensil is often limited from extending beyond the dimensions of the container and therefore the constructible utensil design has pressure to conform which often means to be short and fall within a limiting dimension of the packaging.

Factors that tend to increase a length of the constructible utensil is that there is a certain length that is comfortable for a user when operating and holding a constructed utensil (some of which is informed by the optimum placement of the reference dots). The longer the utensil, the greater range of hands may be comfortably accommodated. In some applications, the constructed utensil must have a minimum length to reach to the bottom/edges of a food container accessed through a container opening.

These factors may compete with each other, such as where one dimension of a container to be associated with delivery of the unconstructed utensil is shorter than a depth of the container. An example is the yogurt container that desirably and sanitarily stores the unconstructed utensil under a lid which can have a diameter smaller than a depth of the container. A version of a spoon lid works in that situation.

Which points out that the folding implementations illustrated and taught herein are sometimes a compromise to the competing length-influencing considerations. When a side packing solution would work, folding may not be required but there are other issues to associating the utensil with the container for the entire manufacture/distribution/retail chain and making sure that the associated utensil is useable and sanitary for the consumer. When there is an overwrap, a long utensil may be secured and covered with the overwrap, but overwraps are not always available. Thus a manufacturer has a need for flexibility in the length of the unconstructed utensil to help design the correct container and associated utensil.

The folding solution, while it may be implemented with any of the embodiments illustrated, and is not constrained to those embodiments of FIG. 9-FIG. 14, folding is not always appropriate. Due to the hysteresis of some types and configurations of foundation material as mentioned herein, there is a tendency of some folded constructible utensils to unfold. To counter this, often a small amount of semi-tacky adhesive is used to secure the folded portion to the body, which further adds to the costs and complexity of defining and folding the utensil for packing. The costs are increased based upon the additional machine and labor costs.

The area of the constructible utensil between the handle edge and discontinuity 210/inflection point 310 is where length is adjustment is easiest. When the utensil needs to be longer, the length of this area increases and when the utensil needs to be shorter, the length of this area decreases, which affects a length of longitudinal linear score 215. Generally the length of linear score 215 and the area closely match, though they do not have to match. When this area has a length of at least 0.5 inches, then the utensil is configured for a good compromise of the factors of the length-influencing consideration, as it is comfortable in the hand without appreciable waste of foundation material. When the length of this area is less than 0.5 inches then a shortening factor typically has greatest weight. Without familiarity with the product and details of its manufacture and use, it would be easy, but mistaken, to believe that many of the dimensions could be independently varied or collectively scaled to meet the length-influencing consideration without realizing its potential negative impact on the functional consideration. In FIG. 2, almost 85% of the overall length (2.75 inches of 3.25 inches) is associated with the functional consideration leaving 15% for length management related adjustments. Other implementations may go as low as ¾-⅔ of the overall length (at least more than 50%) associated with the functional consideration to leave ¼-⅓ of the length (less than 50%) available for length adjustment.

The system and methods above has been described in general terms as an aid to understanding details of preferred embodiments of the present invention. In the description herein, numerous specific details are provided, such as examples of components and/or methods, to provide a thorough understanding of embodiments of the present invention. Some features and benefits of the present invention are realized in such modes and are not required in every case. One skilled in the relevant art will recognize, however, that an embodiment of the invention can be practiced without one or more of the specific details, or with other apparatus, systems, assemblies, methods, components, materials, parts, and/or the like. In other instances, well-known structures, materials, or operations are not specifically shown or described in detail to avoid obscuring aspects of embodiments of the present invention.

Reference throughout this specification to "one embodiment", "an embodiment", or "a specific embodiment" means that a particular feature, structure, or characteristic described in connection with the embodiment is included in at least one embodiment of the present invention and not necessarily in all embodiments. Thus, respective appearances of the phrases "in one embodiment", "in an embodiment", or "in a specific embodiment" in various places throughout this specification are not necessarily referring to the same embodiment. Furthermore, the particular features, structures, or characteristics of any specific embodiment of the present invention may be combined in any suitable manner with one or more other embodiments. It is to be understood that other variations and modifications of the embodiments of the present invention described and illustrated herein are possible in light of the teachings herein and are to be considered as part of the spirit and scope of the present invention.

It will also be appreciated that one or more of the elements depicted in the drawings/figures can also be implemented in a more separated or integrated manner, or even removed or rendered as inoperable in certain cases, as is useful in accordance with a particular application.

Additionally, any signal arrows in the drawings/Figures should be considered only as exemplary, and not limiting, unless otherwise specifically noted. Furthermore, the term "or" as used herein is generally intended to mean "and/or" unless otherwise indicated. Combinations of components or steps will also be considered as being noted, where terminology is foreseen as rendering the ability to separate or combine is unclear.

As used in the description herein and throughout the claims that follow, "a", "an", and "the" includes plural references unless the context clearly dictates otherwise. Also, as used in the description herein and throughout the claims that follow, the meaning of "in" includes "in" and "on" unless the context clearly dictates otherwise.

The foregoing description of illustrated embodiments of the present invention, including what is described in the Abstract, is not intended to be exhaustive or to limit the invention to the precise forms disclosed herein. While specific embodiments of, and examples for, the invention are described herein for illustrative purposes only, various equivalent modifications are possible within the spirit and scope of the present invention, as those skilled in the relevant art will recognize and appreciate. As indicated, these modifications may be made to the present invention in light of the foregoing description of illustrated embodiments of the present invention and are to be included within the spirit and scope of the present invention.

Thus, while the present invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the present invention. It is intended that the invention not be limited to the particular terms used in following claims and/or to the particular embodiment disclosed as the best mode contemplated for carrying out this invention, but that the invention will include any and all embodiments and equivalents falling within the scope of the appended claims. Thus, the scope of the invention is to be determined solely by the appended claims.

What is claimed as new and desired to be protected by Letters Patent of the United States is:

1. A constructible utensil, including:

a deformable generally planar rigid paperboard sheet defining a blank, said blank including:

a handle portion having:

a handle length extending from a first proximal end to a first distal end opposing said proximal end along a first longitudinal axis, said first distal end including a first distal end width perpendicular to said first longitudinal axis; and a free edge at said first proximal end; and a terminal portion having:

a terminal portion length extending from a second proximal end to a second distal end opposing said second distal end along a second longitudinal axis aligned with said first longitudinal axis, said aligned axes forming a central fold axis about which said handle portion and said terminal portion are generally symmetric wherein said second proximal end is coupled to said first distal end and wherein said second distal end includes a curvilinear free edge; and a terminal portion width perpendicular to said second longitudinal axis equal to said first distal end width; and a bowl-forming score pattern including a first continuous score disposed on said blank and having a first continuous score portion extending from a first point spaced away from said fold axis on said handle portion towards a second point on said blank at a first lateral edge proximate said first distal end and a second continuous score disposed on said blank and having a second continuous score portion extending from a third point spaced away from said fold axis on said handle portion towards a fourth point on said blank at a second lateral edge proximate said first distal end, said second continuous score symmetric with said first continuous score about said fold axis;

wherein said scores generally curve away from said fold axis and wherein said score pattern does not include intersecting scores; and wherein said blank is configured with an arrangement of said scores such that a folding of said blank about said fold axis introduces a bowl in said blank by distortion of said blank along said score pattern;

wherein said first continuous score includes a first linear score portion extending from said first point towards a first termination point proximate said first proximal end and said second continuous score includes a second linear score portion extending from said third point towards a second termination point proximate said first proximal end; and wherein said pair of linear scores are convergent, without intersection, towards said fold axis.

2. The constructible utensil of claim 1 wherein said first point and said third point are each within ⅛" of said fold axis.

3. The constructible utensil of claim 1 wherein said score pattern further includes a third continuous score disposed on said blank and extending from a fifth point spaced away from said fold axis on said handle portion towards a sixth point on said blank at said first lateral edge proximate said first distal end and a fourth continuous score disposed on said blank and extending from a seventh point spaced away from said fold axis on said handle portion towards an eighth point on said blank at said second lateral edge proximate said first distal end, said fourth continuous score symmetric with said third continuous score about said fold axis.

4. The constructible utensil of claim 3 wherein said first point and said third point extend closer to said first proximal end than said fifth point and said seventh point.

5. A constructible utensil, including:

a deformable generally planar rigid paperboard sheet defining a blank, said blank including:

a handle portion having:

a handle length extending from a first proximal end to a first distal end opposing said proximal end along a first longitudinal axis, said first distal end including a first distal end width perpendicular to said first longitudinal axis; and a free edge at said first proximal end; and a terminal portion having:

a terminal portion length extending from a second proximal end to a second distal end opposing said second distal end along a second longitudinal axis aligned with said first longitudinal axis, said aligned axes forming a central fold axis about which said handle portion and said terminal portion are generally symmetric wherein said second proximal end is coupled to said first distal end and wherein said second distal end includes a curvilinear free edge; and a terminal portion width perpendicular to said second longitudinal axis equal to said first distal end width; and a bowl-forming score pattern including a first continuous score disposed on said blank and having a first continuous score portion extending from a first point spaced away from said fold axis on said handle portion towards a second point on said blank at a first lateral edge proximate said first distal end and a second continuous score disposed on said blank and having a second continuous score portion extending from a third point spaced away from said fold axis on said handle portion towards a fourth point on said blank at a second lateral edge proximate said first distal end, said second continuous score symmetric with said first continuous score about said fold axis;

wherein said scores generally curve away from said fold axis and wherein said score pattern does not include intersecting scores; and wherein said blank is configured with an arrangement of said scores such that a folding of said blank about said fold axis introduces a bowl in said blank by distortion of said blank along said score pattern;

wherein said first and third points are displaced at least one-half inch from said first proximal end;

wherein said first continuous score includes a first linear score portion extending from said first point towards a first termination point proximate said first proximal end and said second continuous score includes a second linear score portion extending from said third point towards a second termination point proximate said first proximal end; and wherein said pair of linear scores are convergent, without intersection, towards said fold axis.

6. A constructible utensil, including:

a deformable generally planar rigid paperboard sheet defining a blank, said blank including:

a handle portion having:

a handle length extending from a first proximal end to a first distal end opposing said proximal end along a first longitudinal axis, said first distal end including a first distal end width perpendicular to said first longitudinal axis; and a free edge at said first proximal end; and a terminal portion having:

a terminal portion length extending from a second proximal end to a second distal end opposing said second distal end along a second longitudinal axis aligned with said first longitudinal axis, said aligned axes forming a central fold axis about which said handle portion and said terminal portion are generally symmetric wherein said second proximal end is coupled to said first distal end and wherein said second distal end includes a curvilinear free edge; and a terminal portion width perpendicular to said second longitudinal axis equal to said first distal end width; and a bowl-forming score pattern including a first continuous score disposed on said blank and extending from a first point spaced away from said fold axis on said handle portion towards a second point on said blank at a first lateral edge proximate said first distal end and a second continuous score disposed on said blank and extending from a third point spaced away from said fold axis on said handle portion towards a fourth point on said blank at a second lateral edge proximate said first distal end, said second continuous score symmetric with said first continuous score about said fold axis;

wherein said scores generally curve away from said fold axis and wherein said score pattern does not include intersecting scores; and wherein said blank is configured with an arrangement of said scores such that a folding of said blank about said fold axis introduces a bowl in said blank by distortion of said blank along said score pattern;

wherein said score pattern further includes a third continuous score disposed on said blank and extending from a fifth point spaced away from said fold axis on said handle portion towards a sixth point on said blank at said first lateral edge proximate said first distal end and a fourth continuous score disposed on said blank and extending from a seventh point spaced away from said fold axis on said handle portion towards an eighth point on said blank at said second lateral edge proximate said first distal end, said fourth continuous score symmetric with said third continuous score about said fold axis; and wherein said first, third, fifth, and seventh points are displaced at least one-half inch from said first proximal end.

7. The constructible utensil of claim 6 wherein said score pattern further comprises a linear score line extending along said fold axis from said first proximal end towards said first distal end.

8. The constructible utensil of claim 6 wherein said third continuous score and said fourth continuous score are laterally displaced from said fold axis further than said first continuous score and said second continuous score, respectively.

9. The constructible utensil of claim 8 wherein said second point and said fourth point extend along said fold axis further away from said first proximal end than said sixth point and said eight point, respectively.

* * * * *